US006277466B1

(12) United States Patent
McNeil et al.

(10) Patent No.: US 6,277,466 B1
(45) Date of Patent: Aug. 21, 2001

(54) EMBOSSED MULTI PLY CELLULOSIC FIBROUS STRUCTURE AND PROCESS FOR PRODUCING THE SAME

(75) Inventors: Kevin Benson McNeil, Loveland; Michael Sean Pratt, Cincinnati, both of OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/197,940

(22) Filed: Nov. 23, 1998

(51) Int. Cl.[7] ..... D21H 27/30

(52) U.S. Cl. ..... 428/154; 428/156; 428/152; 428/153; 428/166; 428/178; 428/179; 162/132; 162/117; 162/133

(58) Field of Search ..... 428/156, 152, 428/153, 154, 166, 178, 179; 162/132, 117, 133

(56) References Cited

U.S. PATENT DOCUMENTS

| | | | |
|---|---|---|---|
| 3,323,983 | 6/1967 | Palmer et al. | 162/362 |
| 3,414,459 | 12/1968 | Wells | 161/131 |
| 3,547,723 | 12/1970 | Gresham | 156/209 |
| 3,556,907 | 1/1971 | Nystrand | 156/470 |
| 3,708,366 | 1/1973 | Donnelly | 156/209 |
| 3,738,905 | 6/1973 | Thomas | 161/127 |
| 3,867,225 | 2/1975 | Nystrand | 156/209 |
| 4,320,162 * | 3/1982 | Schulz | 428/154 |
| 4,483,728 | 11/1984 | Bauernfeind | 156/209 |
| 5,468,323 | 11/1995 | McNeil | 156/209 |
| 5,620,776 | 4/1997 | Schulz | 428/156 |
| 5,686,168 * | 11/1997 | Laurent et al. | 428/179 |
| 5,846,636 | 12/1998 | Ruppel et al. | 428/154 |

FOREIGN PATENT DOCUMENTS

WO 95/35205 12/1995 (FR) .

* cited by examiner

*Primary Examiner*—William P. Watkins, III
(74) *Attorney, Agent, or Firm*—Jay A. Krebs; Vladimir Vitenberg

(57) ABSTRACT

An embossed multiple ply paper product having a nested latticework embossment pattern providing a cloth-like, quilted appearance and a process for embossing and bonding such multiple ply paper product. The multiple ply paper product comprises a latticework of cells composed of n rows of embossment elements nested within an interfacing latticework of cells composed of n+1 rows of embossment elements.

12 Claims, 6 Drawing Sheets

EMBOSSED MULTI PLY CELLULOSIC FIBROUS STRUCTURE AND PROCESS FOR PRODUCING THE SAME

FIELD OF THE INVENTION

The present invention relates to multiple ply cellulosic fibrous structures, particularly embossed multiple ply cellulosic fibrous structures and the process for producing such structures.

BACKGROUND OF THE INVENTION

Cellulosic fibrous structures are a staple of everyday life. Cellulosic fibrous structures are used as consumer products for paper towels, toilet tissue, facial tissue, napkins and the like. The large demand for such paper products has created a demand for improved versions of the products and the methods of their manufacture.

Multiple ply cellulosic fibrous structures are very well known in the art of consumer products. Such products are cellulosic fibrous structures having more than one, typically two, plies superimposed in face-to-face relationship to form a laminate. It is known in the art to emboss sheets comprising multiple plies of tissue for aesthetic purposes and to maintain the plies in face-to-face relation during use. In addition, embossing can increase the surface area of the plies thereby enhancing their bulk and water holding capacity.

During the embossing process, the plies are fed through a nip formed between juxtaposed axially parallel rolls. Embossment knobs on these rolls compress like regions of each ply into engagement and contacting relationship with the opposing ply. The compressed regions of the plies produce an aesthetic pattern and provide a means for joining and maintaining the plies in face-to-face contacting relationship.

Embossing is typically performed by one of two processes, knob-to-knob embossing or nested embossing. Knob-to-knob embossing consists of axially parallel rolls juxtaposed to form a nip between the knobs on opposing rolls. Nested embossing consists of embossment knobs of one roll meshed between the embossment knobs of the other roll. Examples of knob-to-knob embossing and nested embossing are illustrated in the prior art by U.S. Pat. Nos. 3,414,459 issued Dec. 3, 1968 to Wells and commonly assigned; U.S. Pat. No. 3,547,723 issued Dec. 15, 1970 to Gresham; U.S. Pat. No. 3,556,907 issued Jan. 19, 1971 to Nystrand; U.S. Pat. No. 3,708,366 issued Jan. 2, 1973 to Donnelly; U.S. Pat. No. 3,738,905 issued Jun. 12, 1973 to Thomas; U.S. Pat. No. 3,867,225 issued Feb. 18, 1975 to Nystrand and U.S. Pat. No. 4,483,728 issued Nov. 20, 1984 to Bauernfeind.

Knob to knob embossing produces a cellulosic fibrous structure composed of pillowed regions which enhance the thickness of the product. However, the pillows have a tendency to collapse under pressure due to lack of support. Consequently, the thickness benefit is typically lost during the balance of the converting operation and subsequent packaging, diminishing the quilted appearance sought by embossing.

Nested embossing has proven to be the preferred process for producing products exhibiting a softer more quilted appearance that is maintained throughout the balance of the converting process including packaging. With nested embossing, one ply has a male pattern, while the other ply has a female pattern. As the two plies travel through the nip of the embossment rolls, the patterns are meshed together.

Nested embossing aligns the knob crests on the male embossment roll with the low areas on the female embossment roll. As a result, the embossed sites produced on one ply provide support for the embossed sites on the other ply.

The lamination point at the nip between nested embossment rolls is typically eliminated, since the knobs on the nested embossment rolls do not touch. This necessitates the addition of a marrying roll to apply pressure for lamination. Typical marrying rolls are solid resulting in the lamination of every potential laminating point as shown in U.S. Pat. No. 3,867,225 issued Feb. 18, 1975 to Nystrand.

The nested embossment rolls may be designed such that the knobs on one roll contact the periphery of the other embossing roll providing a lamination point, thereby eliminating the need for a marrying roll. Such nested embossing arrangement is shown in U.S. Pat. No. 5,468,323 issued Nov. 21, 1995 to McNeil. This arrangement also provides a means for improving the bond strength between the plies by enabling a glue applicator roll to be used in conjunction with each of the embossment rolls providing an adhesive joint at each of the embossed sites.

Consumer testing of products having embossed cellulosic fibrous structures have determined that a softer, more quilted appearance is desired. Consumers desire products having relatively high caliper with aesthetically pleasing decorative patterns exhibiting a high quality cloth-like appearance. Such attributes must be provided without sacrificing the products' other desired qualities of softness, absorbency, drape (limpness) and bond strength between the plies.

Different attempts have been made in the art to produce paper products exhibiting superior functional properties as well as aesthetically pleasing decorative qualities. The present invention provides an embossed multiple ply tissue where the embossment patterns on each of the two plies are designed with specific objectives in mind. For instance, the embossed pattern on the first ply is based primarily on aesthetics while the embossed pattern on the second ply is based primarily on functional properties such as thickness and strength. In addition, the quantity and locations of the connections between the two plies are limited in order to coordinate the bond strength between the two plies with softness and drape of the final product.

SUMMARY OF THE INVENTION

The present invention comprises a multiple ply cellulosic fibrous structure comprising a first ply having n embossed rows forming a latticework of cells and a second ply having n+1 embossed rows forming a latticework of cells. The first and second plies are bonded in a face-to-face relationship such that the n embossed rows of the first ply are nested within the n+1 embossed rows of the second ply. In alternate embodiments, the first ply includes a plurality of indicia disposed within the latticework of cells for aesthetic appeal. In another embodiment, the first and second plies are bonded exclusively at said indicia.

The invention further comprises a process for producing such multiple ply cellulosic structures. The process comprises the steps of providing a first ply embosser and a second ply embosser, wherein each said first and second ply embossers comprises a pressure roll juxtaposed axially parallel to a pattern roll to form a nip therebetween. Each of the pattern rolls comprises a plurality of radially oriented embossment knobs projecting from a periphery. The embossment knobs on the first pattern roll form a latticework of cells composed of n embossed rows and the embossment knobs on the second pattern roll form a latticework of cells comprising n+1 embossed rows. First and second plies of tissue are interposed between the nips of the first and second ply embossers such that latticework embossment patterns comprising n and n+1 rows of embossment elements, respectively, are compressed thereon. Subsequently, the first and second plies are joined in a face to face relationship such that said n embossed rows of said first ply are nested within said n+1 rows of said second ply.

In alternate embodiment, the process includes a means for bonding the two plies by providing an adhesive applicator roll in conjunction with one or both pattern rolls. In still another embodiment, the process includes providing a steel anvil roll juxtaposed axially parallel to one of the two pattern rolls for bonding the two plies via high pressure embossing.

BRIEF DESCRIPTION OF THE DRAWINGS

These and other features, aspects and advantages of the present invention will become better understood with regard to the following description, appended claims, and accompanying drawings where:

DETAILED DESCRIPTION OF THE INVENTION

Definitions

As used herein, the following terms have the following meanings:

"Machine direction", designated MD, is the direction parallel to the flow of paper through the papermaking equipment.

"Cross machine direction", designated CD, is the direction perpendicular to the machine direction in the X-Y plane.

"Embossing" refers to the process of deflecting a relatively small portion of a cellulosic fibrous structure normal to its plane and impacting the projected portion of the fibrous structure against a relatively hard surface to permanently disrupt the fiber to fiber bonds.

A "nip" is a loading plane connecting the centers of two parallel axes.

"Nonrandom," refers to a predictable disposition and may occur as a result of known and predetermined features of the manufacturing process.

"Repeating" means the pattern is formed more than once.

"Discrete," means the adjacent embossed sites are not contiguous.

"Essentially continuous" refers to a region extending substantially throughout the fibrous structure in one or both of its principal directions.

"Crenulated emboss elements" are emboss elements formed into crenels and merlons such that the side of the emboss element would resemble the top of a castle wall having spaced projections which are merlons and depressions therebetween which are crenels.

An "indicia" is a distinctive marking, exhibiting a decorative aspect.

A "latticework" is a pattern of small intersecting diagonal or zigzag segments or angles.

A "cell" is a unit of a two-dimensional array comprising a group of individual enclosures.

The specification contains a detailed description of (1) the embossing laminating system of the present invention and (2) the finished paper product of the present invention.

(1) The Embossing/Laminating Equipment

Figure 1:
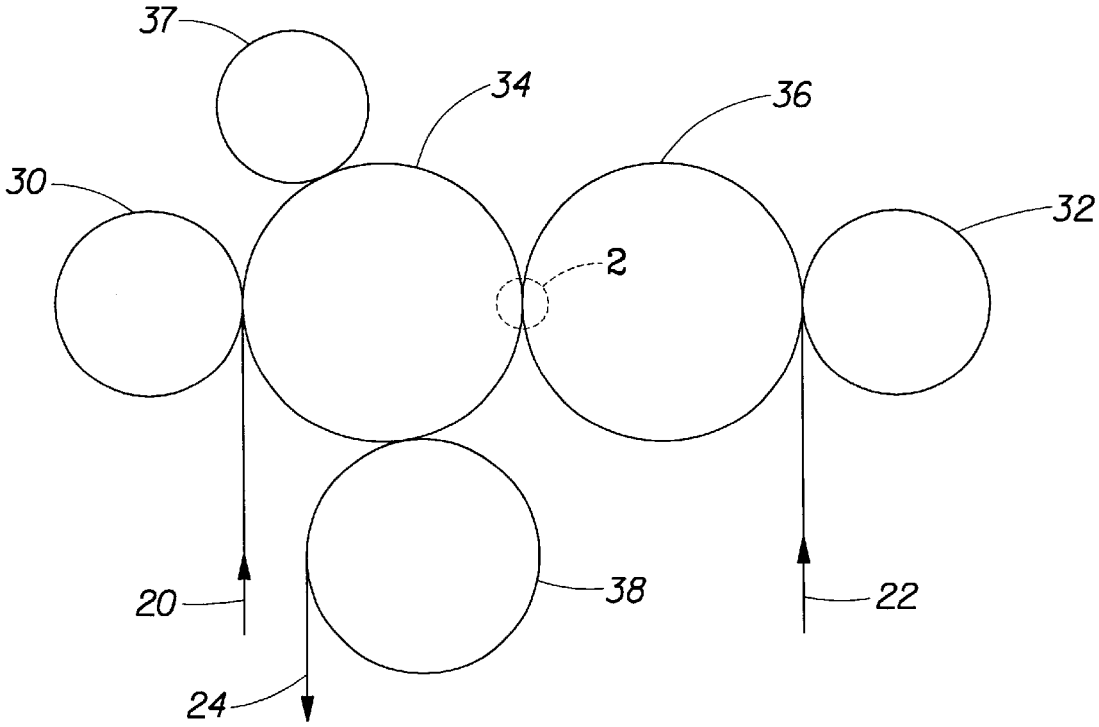
FIG. 1 is a schematic side elevational view of an apparatus used to perform nested embossing and adhesive bonding of two plies according to the present invention.

Illustrated in FIG. 1 is an embossing and laminating system used to manufacture cellulosic fibrous structures for consumer paper products. The system depicted performs a process referred to in the prior art as nested embossing. In nested embossing two plies 20 and 22 are embossed between mated pressure rolls 30 and 32 and likewise mated pattern rolls 34 and 36. The pressure rolls 30 and 32 and pattern rolls 34 and 36 are juxtaposed with parallel axes to form three nips, a first nip between the first pressure roll 30 and the first pattern roll 34, a second nip between the second pressure roll 32 and the second pattern roll 36, and a third nip between the first and second pattern rolls 34 and 36. Although the present invention is equally applicable to all types of consumer paper products such as paper towels, toilet tissue, facial tissue, napkins, and the like, the embossing process used to produce the multiple ply tissue 24 as well as the multiple ply tissue 24 produced thereby are representative of toilet tissue.

Pattern rolls 34 and 36 have knobs 33 which extend radially outwardly and contact the periphery of the respective pressure rolls 30 or 32 at the respective nips. Each ply 20 or 22 to be joined into the resulting multiple ply cellulosic fibrous structure 24 is fed through one of the nips between the pattern rolls 34 or 36 and the respective pressure roll 30 or 32. Each ply 20 or 22 is embossed in the nip by the knobs 33 of the respective pattern roll 34 or 36.

For the present invention, the embossment pattern disposed on the first pattern roll 34 is a latticework of cells comprising n arcuate rows of embossment elements. The embossment pattern disposed on the second pattern roll 36 is a latticework of cells comprising n+1 arcuate rows of embossment elements.

After embossing, one of the plies 20 or 22 may have adhesive applied to the resulting crests 27 of the embossed sites 26 by an adhesive applicator roll 37. The adhesive applicator roll 37 may be utilized in conjunction with either ply 20 or 22. In this process, the crests 27 of the embossed sites 26 are the only portion of the ply 20 or 22 to which adhesive is applied, because the crests 27 of the embossed sites 26 are the only portions of the ply 20 or 22 contacting the adhesive applicator roll 37.

The plies 20 and 22 are then fed through the nip between the first and second pattern rolls 34 and 36. The patterns on each of the two rolls 34, 36 are arranged such that the n rows of embossment elements on the first pattern roll 34 mesh within the n+1 rows of embossment elements on the second pattern roll 36 at the nip formed between the two rolls 34, 36.

Figure 2:
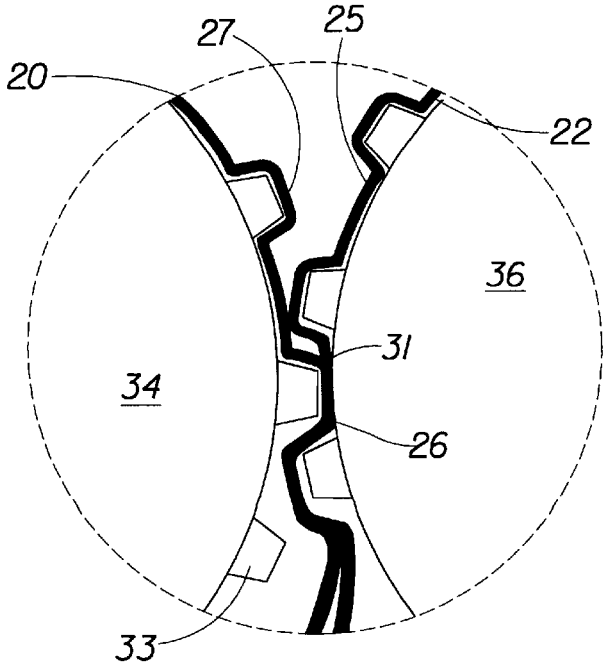
FIG. 2 is a side view of a nip formed between the two pattern rolls displayed in FIG. 1.

As shown in FIG. 2, the knobs 33 on each respective pattern roll 34, 36 approach the periphery 31 of the neighboring pattern roll without making contact therewith. In this nip, the plies 20 and 22 are juxtaposed in a face-to-face relationship with the crests 27 of the embossed sites 26 on one ply 20, 22 registered with nonembossed regions 25 on the other ply 20, 22.

The two plies 20 and 22 are then fed through a nip between the pattern roll 34 associated with the adhesive applicator roll 37 and a marrying roll 38, to insure the crests of the first ply 20 embossed sites 26 having the adhesive applied from the adhesive applicator roll 37 are bonded to the nonembossed regions 25 of the second ply 22. Contact between the pattern roll 34 and the marrying roll 38 is limited to the embossed sites 26 of the first ply 20.

In an alternate embodiment (not shown), the pattern rolls 34, 36 can be designed such that the knobs 33 on each of the rolls contact the periphery of the opposing roll bonding the plies 20, 22 at the nip which is formed therebetween, thus eliminating the need for the marrying roll 38. Such arrangement is disclosed in commonly assigned U.S. Pat. No 5,468,323 issued Nov. 21, 1995 to McNeil and is incorporated herein by reference. For such an arrangement, an adhesive applicator roll 37 may be used in conjunction with each of the pattern rolls so that lamination points may be formed between the plies at each of the knobs 33 on the two pattern rolls 34, 36.

Figure 3:
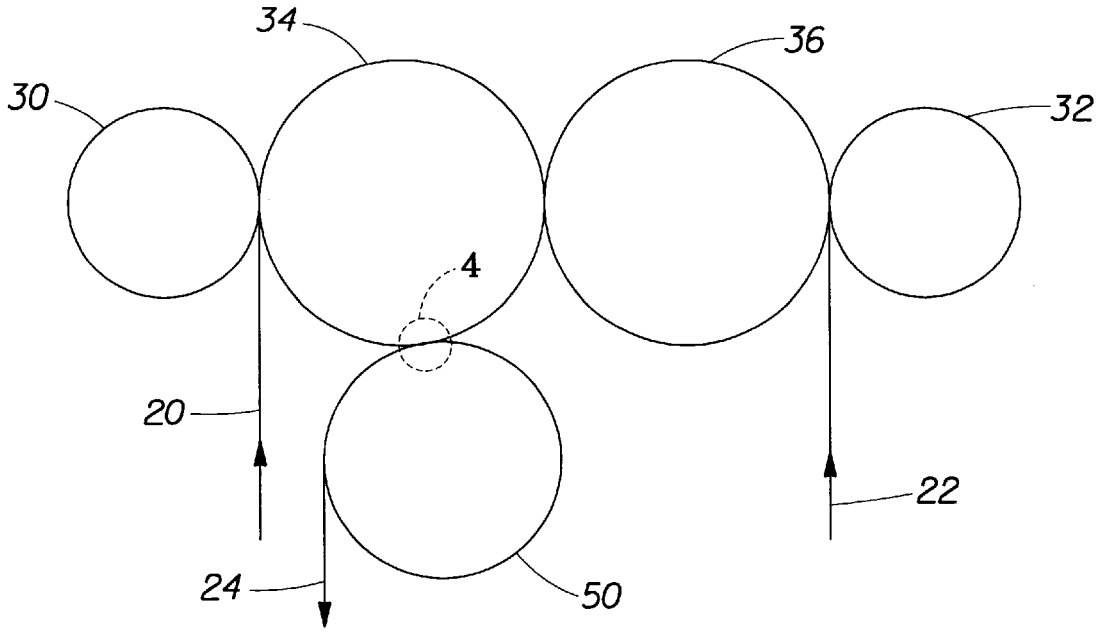
FIG. 3 is a side elevational view of an apparatus used to perform nested embossing and bonding of two plies utilizing high pressure embossing according to the present invention.
Figure 4:
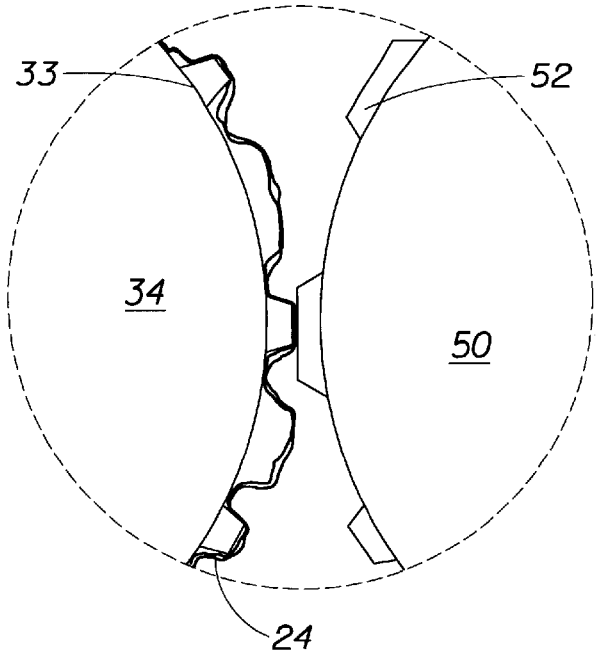
FIG. 4 is a side view of a high pressure embossing nip formed between a pattern roll and the steel anvil roll displayed in FIG. 3.

In another embodiment, the two plies 20, 22 may be bonded by high pressure embossing. As shown in FIG. 3, the adhesive applicator roll 37 is eliminated and the first pattern roll 34 is paired with a steel anvil roll 50 in place of the marrying roll 38. Once the two plies pass through the nip between the first and second pattern rolls 34, 36 and are thereby juxtaposed in a face to face relationship, the plies 20, 22 are made to pass through the nip between the first pattern roll 34 and the steel anvil roll 50. As shown in FIG. 4, the knobs 33 on the first pattern roll 34 act in conjunction with land areas 52 on the steel anvil roll 50 to apply high unit pressures to the surfaces of the two plies 20, 22 disposed therebetween. The land areas 52 on the steel anvil roll have sizes which correspond to and slightly exceed the dimension associated with the interfacing knob portions of the mating pattern roll 34 where the bonds are to occur.

High pressure embossing bonds the two plies by interlocking the fibers and reducing them to plastic. The resulting bonds exhibit a glassine appearance which is aesthetically pleasing. Bonding via high pressure embossing is disclosed in U.S. Pat. No. 3,323,983 issued Sep. 8, 1964 to Palmer and is incorporated herein by reference.

(2) The Embossed Paper Product

The present invention provides a tissue paper product having functional characteristics of softness, absorbency, and drape as well as exhibiting aesthetically pleasing decorative attributes. Such aesthetically pleasing features include patterns displaying a high quality cloth-like appearance and particularly, a softer, more quilted look.

For the present invention, the embossment patterns on each of the two plies serve different objectives and therefore, are visually distinguishable. For instance, the pattern on the first ply is devised with a focus primarily on aesthetics, while the pattern on the second ply is devised to enhance functional properties such as thickness and strength. Once the two plies are joined in a face-to-face relationship, the distinguished patterns mesh with one another such that the embossment pattern on the second ply compliments the pattern on the first ply.

Figure 5:
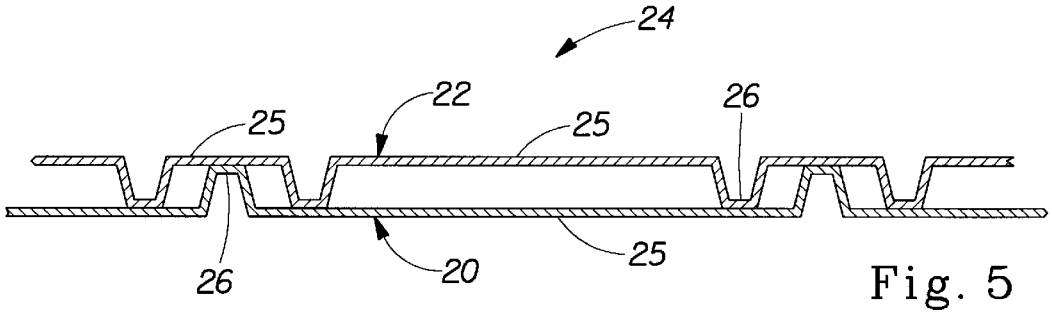
FIG. 5 is a fragmentary vertical sectional view of an embossed multiple ply paper product according to the present invention.

Referring to FIG. 5, the cellulosic fibrous structure 20 according to the present invention comprises two plies 20 and 22 joined in face-to-face relation. Each of the plies 20 and 22 has two distinct zones, an essentially continuous nonembossed region 24, and discrete embossed sites 26 projecting generally outward therefrom and preferably orthogonal thereto. It is to be understood that each ply 20 or 22 may be directly joined to the opposite ply 22 or 20, or, may be connected through an intermediate layer (not shown) interposed between the plies 20 and 22.

As shown in FIG. 5, the embossed elements 26 on the first ply 20 are nested between the embossed elements 26 on the second ply 22 such that embossment elements 26 on the second ply 22 occur on opposite sides of each of the embossment elements 26 on the first ply 20. This arrangement improves the multiple ply tissue in three ways. First, it provides a larger nonembossed region on the first ply 20 providing space for positioning indicia to enhance the decorative quality of the first ply. Secondly, the additional row of embossment elements 26 on the second ply 22 provides extra support for the larger nonembossed regions 25 on the first ply 20 thereby increasing the caliper of the multiple ply tissue. Thirdly, this nested arrangement enhances the cloth-like, quilted appearance of the multiple ply tissue.

Figure 6A:
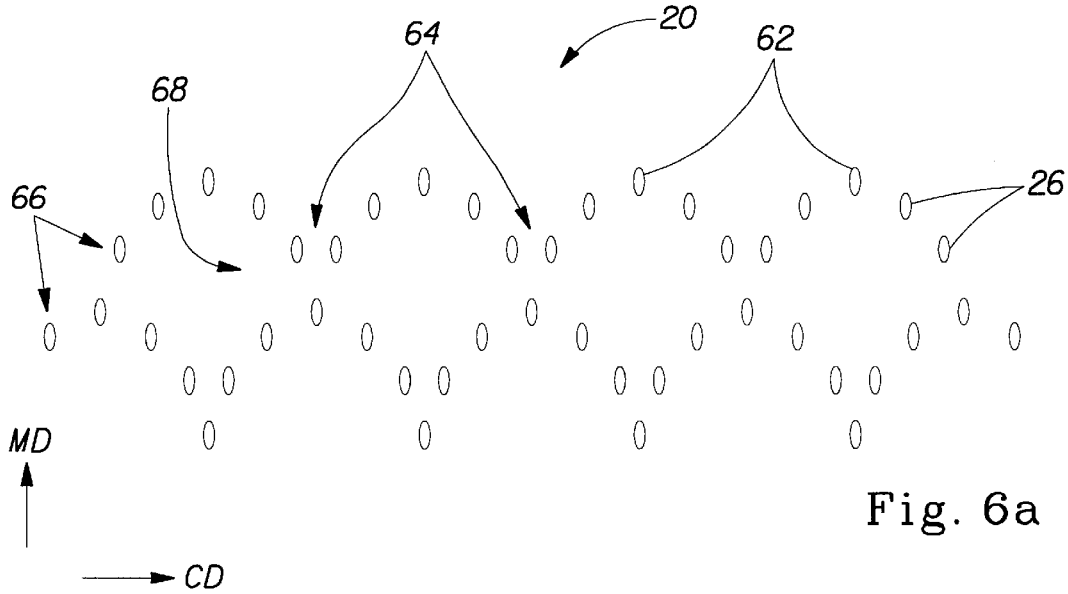
FIG. 6*a* is a fragmentary plan view of the multiple ply paper product shown in FIG. 5 displaying the embossment pattern on the first ply.
Figure 6B:
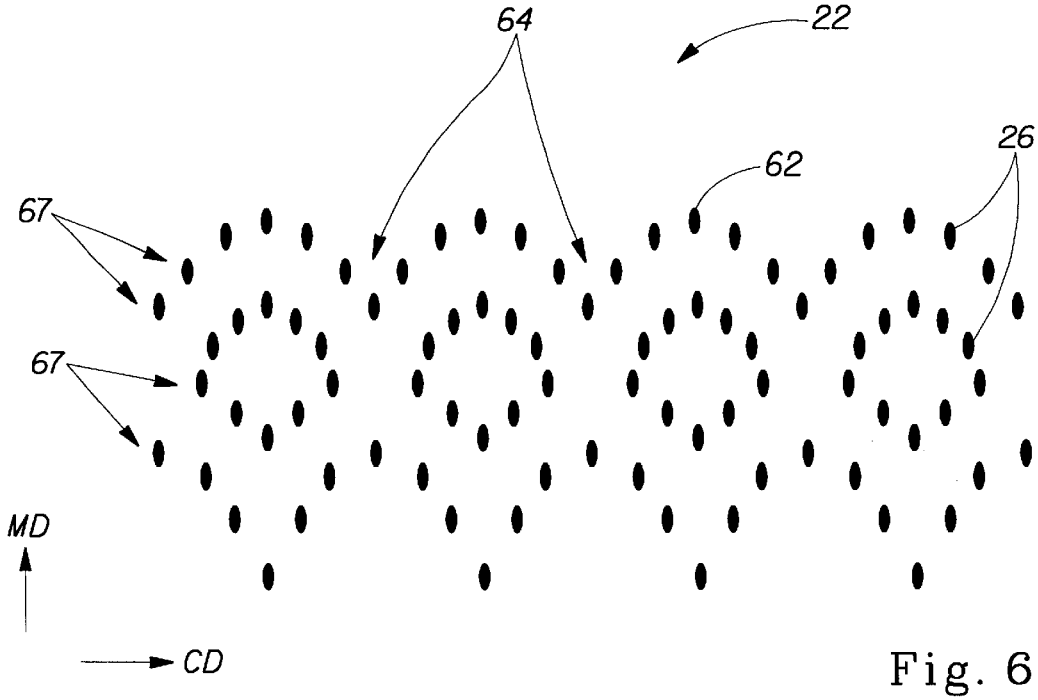
FIG. 6*b* is a fragmentary plan view of the multiple ply paper product shown in FIG. 5 displaying the embossment pattern on the second ply.

The embossment pattern for the present invention comprises a latticework of cells. FIG. 6*a* depicts a plan view of the latticework of cells embossed on the first ply 20 and FIG. 6*b* depicts a plan view of the latticework of cells embossed on the second ply 22. Although the latticework of cells on each of the two plies are composed of arcuate rows of discrete embossment elements 26 forming apices 62 and vertices 64, the latticework of cells may comprise other configurations having rectilinear or serpentine rows of embossment elements.

As shown in FIGS. 6*a* and 6*b*, the latticework of cells on the first ply 20 are defined by single arcuate rows 66 of embossment elements 26 while the cells on the second ply 22 are defined by two rows 67 of embossment elements 26. Once the two plies 20, 22 are joined together in a face to face relationship, the single arcuate rows 66 on the first ply become nested within the two rows 67 on the second ply. This nested arrangement, illustrated in FIG. 6*c*, provides a softer, more quilted look.

Figure 6C:
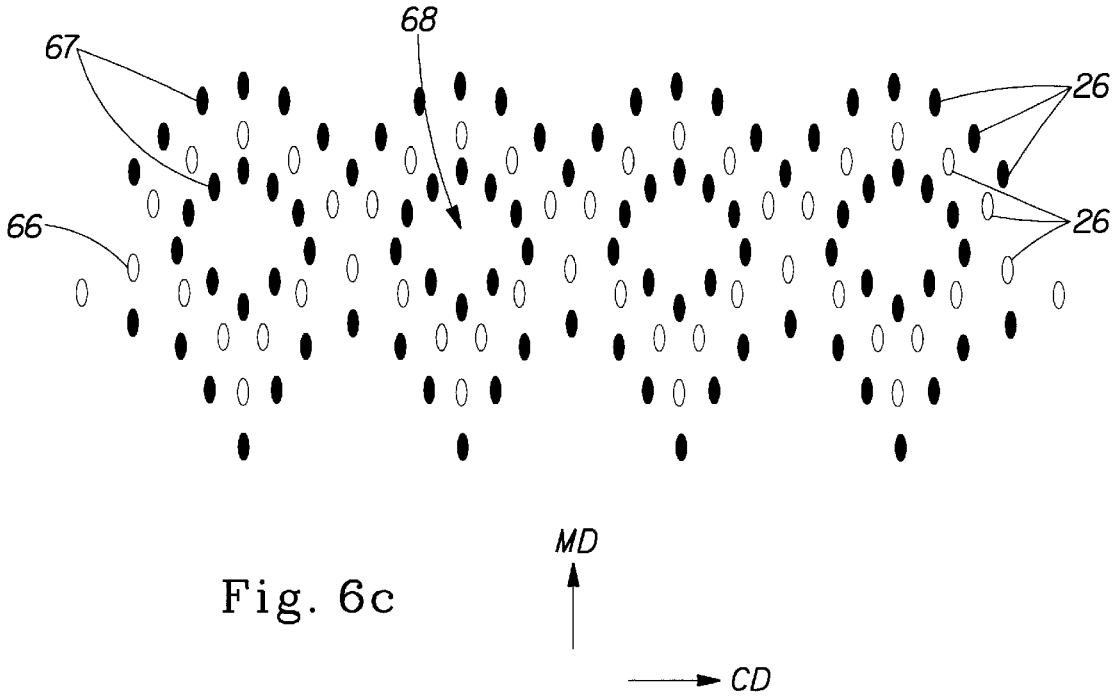
FIG. 6*c* is a fragmentary plan view of the multiple ply paper product shown in FIG. 5 displaying the first ply embossment pattern illustrated in FIG. 6*a* nested within the second ply embossment pattern illustrated in FIG. 6*b*.

Although the latticework of cells for the two plies 20, 22 depicted in FIGS. 6*a*, 6*b*, and 6*c* comprises a first ply 20, single row 66 latticework of cells nested within a second ply 22, double row 67 latticework of cells, it is apparent that other nested latticework arrangements would provide similar or improved cloth like appearances. For the present invention, it is preferred to nest every row 66 of embossment elements 26 on the first ply 20 between two rows 67 of embossment elements 26 on the second ply. In other words, if the latticework of cells on the first ply 20 comprises n rows of embossment elements 26 then it is preferred that the latticework of cells on the second ply 22 comprise n+1 rows of embossment elements 26 (where n is an integer 1,2, 3 . . . etc.).

For the nested arrangement illustrated in FIG. 6*c*, each of the embossment elements 26 forming the n rows 66 on the first ply can be radially aligned or nonaligned with the embossment elements 26 forming the n+1 rows 67 on the second ply. In addition, for the nested arrangement, each of the rows 66 of embossment elements 26 on the first ply can be arranged equidistant or nonequidistant from the adjacent rows 67 of embossment elements on the second ply 22.

Figure 7:
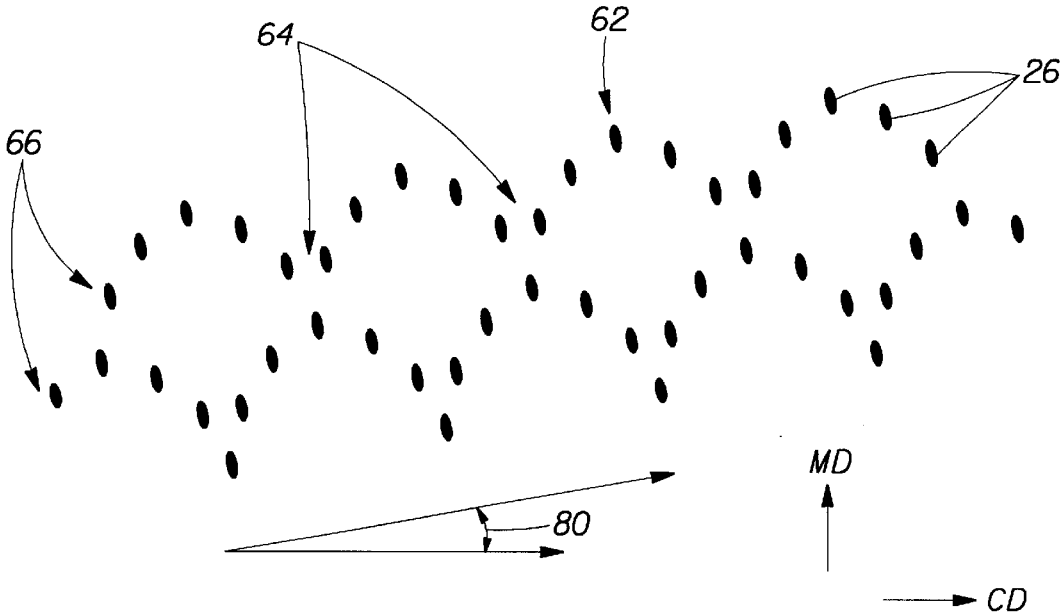
FIG. 7 is a fragmentary plan view of a latticework embossment pattern showing apices and vertices skewed relative to CD and MD.

As shown in FIGS. 6*a* and 6*b*, the rows 66 making up the latticework of cells are disposed in a repeating array extending transversely in the CD. The latticework is typically arranged such that the apices 62 and the vertices 64 are aligned parallel to both the MD and the CD. In an alternate embodiment, the latticework of cells are offset in the CD. As illustrated in FIG. 7, the cells are arranged such that the vertices and apices are skewed at an angle 80 which is offset from the CD. Such skewed angle may range from about 4° to about 10°.

For the present invention, the first ply 20 represents the outside ply of a multiple ply tissue which is typically exposed to a consumer during use. In order to further enhance the decorative quality of the product, indicia 90, illustrated in FIG. 8*a*, may be disposed within the latticework of cells 68 on the first ply 20 in a nonrandom, repeating manner. The space within the latticework of cells on the first ply 20 for such indicia 90 is made available by limiting the number of rows of embossment elements 26. Although the indicia 90 may comprise any visually appealing image, for the present invention, the indicia 90 comprise flower 92 and heart shapes 94.

The indicia 90 may be embossed during the embossment process or printed by a printing operation subsequent to the embossing process. However, in order to further enhance the quilted appearance of the tissue, it is preferred to emboss the indicia 90. The embossed indicia are typically formed by including the image for the indicia in the embossment pattern disposed on the first pattern roll previously described.

Figure 8A:
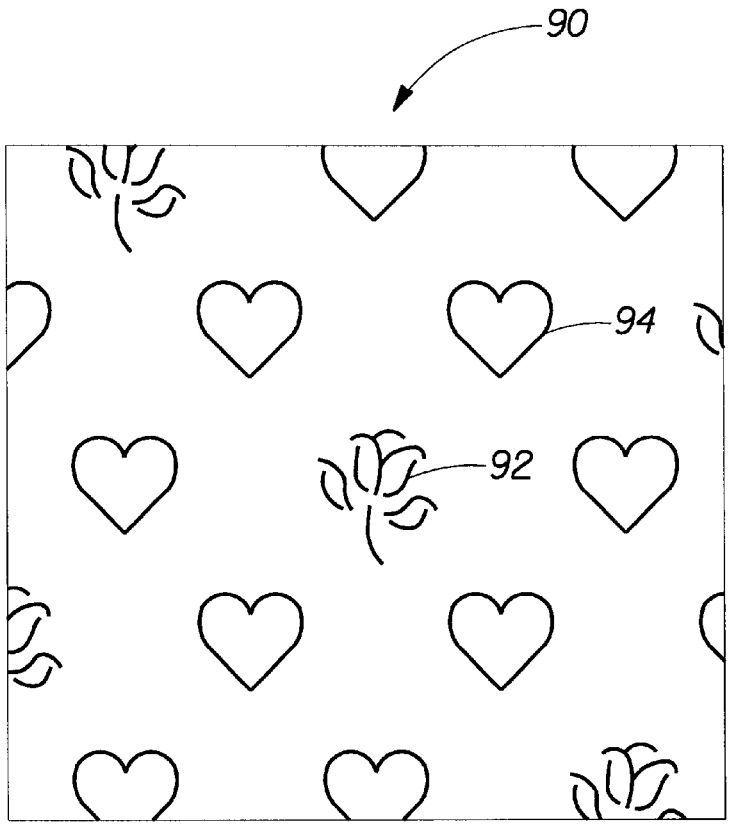
FIG. 8*a* is a plan view of linear flower shaped indicia and heart shaped indicia.
Figure 8B:
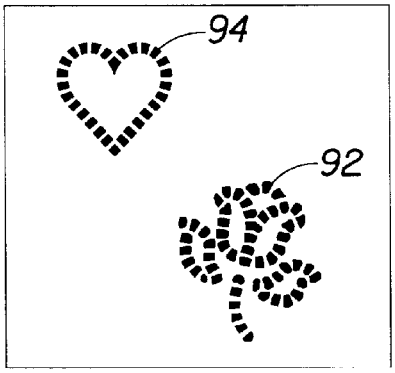
FIG. 8*b* is a plan view of the indicia shown in FIG. 8*a* comprising crenulated patterns.

The indicia 90 may comprise a linear pattern as shown in FIG. 8*a*, or a crenulated pattern as shown in FIG. 8*b*. The linear pattern comprises an essentially continuous embossed design while the crenulated pattern comprises crenulated emboss elements. The crenulated emboss elements add bulk to the paper substrate and enhance the definition and retention of the embossed pattern. Crenulated decorative images are disclosed in U.S. Pat. No. 5,620,776 issued Apr. 15, 1997 to Schulz.

Figure 9A:
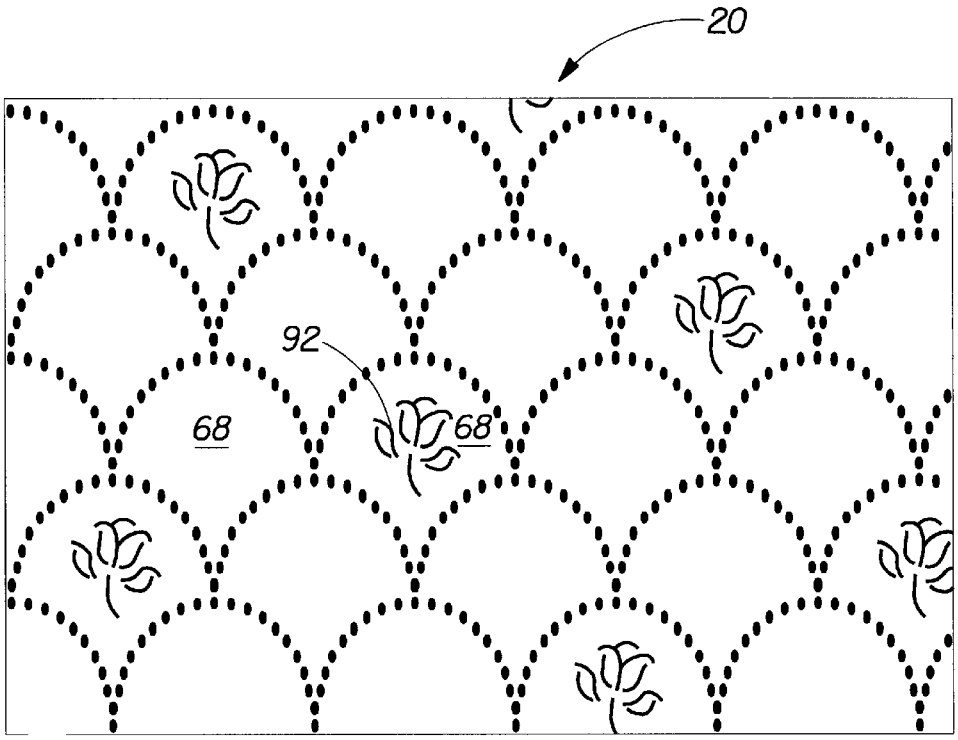
FIG. 9*a* is a plan view of the first ply showing the embossed latticework of cells having flower shaped indicia disposed therein.

In one embodiment shown in FIG. 9*a*, the first ply 20 comprises a latticework of cells having indicia 90 disposed in a pattern running diagonal to both MD and CD where less than all of the cells in the diagonal pattern include indicia 90 disposed therein. The pattern alternates from a diagonal row having all empty cells 68 to a diagonal row where every other cell 68 comprises a flower shaped indicia 92 disposed therein.

Figure 9B:
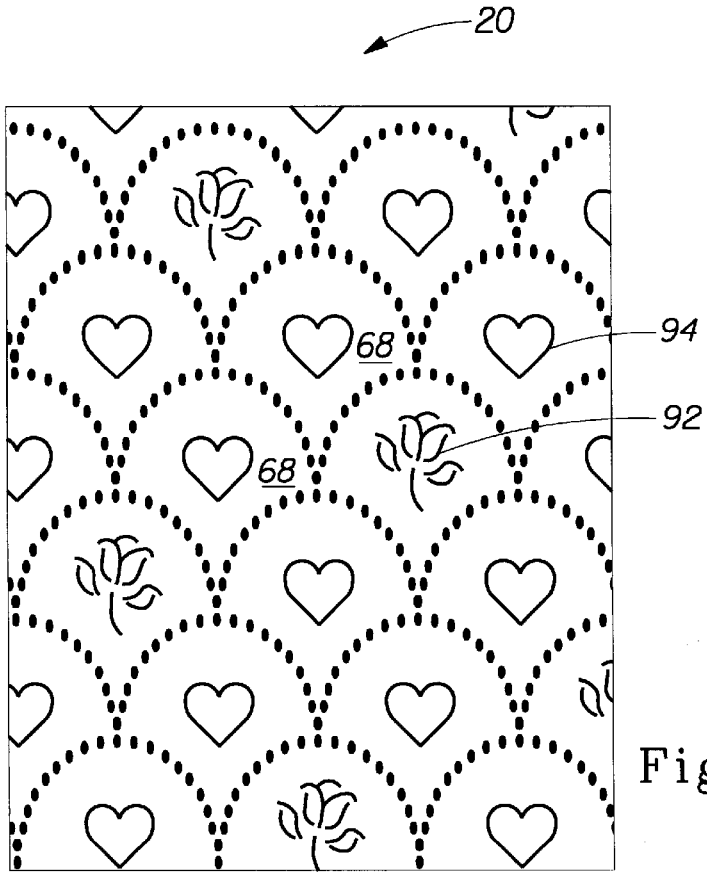
FIG. 9*b* is a plan view of the first ply showing the embossed latticework of cells having flower shaped and heart shaped indicia disposed therein.

In an alternate embodiment shown in FIG. 9*b*, the first ply 20 comprises a latticework of cells where each cell 68 includes an indicia disposed therein. For this embodiment, two indicia 90, 92 comprising a flower 92 and a heart 94 are disposed within the latticework of cells in a pattern running diagonal to both MD and CD. Every other diagonal row of cells 68 in the pattern shifts from having all heart shaped indicia to alternating heart and flower shaped indicia.

The distal end of each embossed site 26 on each of the two plies 20, 22 projects towards and contacts the nonembossed region 25 of the opposite ply. Bonding the plies at the embossed sites 26 improves the appearance of the tissue by providing a more permanent structure that inhibits subsequent dissipation caused by compressive forces, humidity, and absorption. The two plies 20, 22 may be bonded at every embossed site 26 or at selective discrete sites depending on the process.

The number of bond sites occurring between the two plies not only affects the bond strength but also the product stiffness and drape. Whether the plies 20, 22 are joined adhesively or via high pressure embossing, the greater the bond area the stiffer the tissue. Stiffness has a direct impact on product softness and drape. Therefore, it is preferred to minimize the bond area by limiting the region bonded between the two plies 20, 22 to selective discrete sites.

The two plies 20, 22 may be joined at selective sites by adhesive bonds or high pressure embossments using the processes previously described. For selective adhesive bonds, the adhesive applicator roll is synchronized with selective discrete embossment locations on the mating pattern roll. Alternatively, for selective high pressure bonds, land areas are formed on the steel anvil roll matching the selective discrete embossment locations on the neighboring pattern roll. The sizes of the land areas correspond to and slightly exceeds the dimensions of the embossments on the pattern roll where the selective bonds are desired.

As previously described, high pressure embossing produces a glassine bond site that enhances the decorative quality of the tissue. Therefore, for the present invention, it is preferred to form the selective bond sites via high pressure embossing. Particularly, it is preferred to bond the two plies by high pressure embossing such that the area bonded between the two plies 20, 22 comprises about 2% to about 5% of the interfacing surface area between the two plies 20, 22.

Although any pattern of embossment elements 26 may be selected for the selective bond sites, it is preferred to choose a nonrandom pattern of embossment elements providing adequate bond strength using minimal surface area. For the present invention, it is preferred to limit the selective bond sites to the n rows of embossment elements forming the latticework of cells on the first ply. It is more preferred to limit the selective bond sites to the embossed indicia 90 disposed within the latticework of cells on the first ply 20. It is most preferred to limit the selective bond sites to either the flower shaped indicia 92 or the heart shaped indicia 94 disposed within the latticework of cells on the first ply 20.

While particular embodiments of the present invention have been illustrated and described, it would be obvious to those skilled in the art that various other changes and modifications can be made without departing from the spirit and scope of the invention. It is intended to cover in the appended claims all such changes and modifications that are within the scope of the invention.

What is claimed is:

1. A multiple ply tissue comprising:

a first ply having n embossed rows forming a latticework defining a plurality of cells; and a second ply having n+1 embossed rows forming a latticework defining a plurality of cells, wherein said first ply and said second ply are bonded in a face to face relationship such that the n embossed rows of the first plurality are nested within the n+1 embossed rows of the second ply, and wherein said first and second plies are bonded in a nested pattern such that the embossed rows of at least one of the first and second plies support a nonembossed portion of the other ply.

2. The multiple ply tissue of claim 1, wherein said first and second plies are bonded at the n embossed rows of said first ply.

3. The multiple ply tissue of claim 1, wherein said first and second ply are bonded at less than all said n+1 rows of said second ply.

4. The multiple ply tissue of claim 1, further comprising indicia disposed in less than all of said plurality of cells.

5. The multiple ply tissue of claim 4, wherein all of said cells include indicia disposed therein.

6. The multiple ply tissue of claim 4, wherein said indicia are limited to the first ply.

7. The multiple ply tissue of claim 4, wherein said indicia are embossed.

8. The multiple ply tissue of claim 4, wherein said first and second plies are bonded exclusively at said indicia.

9. The multiple ply tissue of claim 5, wherein said first and second plies are bonded and wherein said bonds are limited to less than all of said indicia.

10. The multiple ply tissue of claim 2, wherein said indicia are printed.

11. The multiple ply tissue of claim 1, wherein said cells are offset in the cross machine direction.

12. The multiple ply tissue of claim 3, wherein said latticework comprises discrete elements.

* * * * *

UNITED STATES PATENT AND TRADEMARK OFFICE

CERTIFICATE OF CORRECTION

PATENT NO. : 6,277,466 B1
DATED : August 21, 2001
INVENTOR(S) : Kevin Benson McNeil et al.

It is certified that error appears in the above-identified patent and that said Letters Patent is hereby corrected as shown below:

Column 8,
Line 64, "plurality" should read -- ply --.

Signed and Sealed this

Eighteenth Day of June, 2002

*Attest:*

*Attesting Officer*

JAMES E. ROGAN
*Director of the United States Patent and Trademark Office*